US007197117B2

(12) United States Patent
Sakata et al.

(10) Patent No.: US 7,197,117 B2
(45) Date of Patent: Mar. 27, 2007

(54) ROTATING ANODE X-RAY TUBE AND X-RAY GENERATOR

(75) Inventors: Masataka Sakata, Hino (JP); Tomohiro Chaki, Tachikawa (JP); Masaru Okazaki, Hino (JP); Yuji Kusaka, Akishima (JP); Shiro Umegaki, Akishima (JP); Atsushi Hamanaka, Akiruno (JP); Masahiro Nonoguchi, Hamura (JP)

(73) Assignee: Rigaku Corporation, Tokyo (JP)

( * ) Notice: Subject to any disclaimer, the term of this patent is extended or adjusted under 35 U.S.C. 154(b) by 0 days.

(21) Appl. No.: 11/180,190

(22) Filed: Jul. 13, 2005

(65) Prior Publication Data

US 2006/0013364 A1 Jan. 19, 2006

(30) Foreign Application Priority Data

Jul. 15, 2004 (JP) ..... 2004-208730

(51) Int. Cl.
*H01J 35/10* (2006.01)

(52) U.S. Cl. ..... 378/130; 378/127; 378/141; 378/199; 378/200

(58) Field of Classification Search ..... 378/127, 378/130, 141, 199, 200
See application file for complete search history.

(56) References Cited

U.S. PATENT DOCUMENTS 4,165,472 A * 8/1979 Wittry ..... 378/127
4,405,876 A * 9/1983 Iversen ..... 378/130
4,622,687 A * 11/1986 Whitaker et al. ..... 378/130
4,625,324 A * 11/1986 Blaskis et al. ..... 378/130
4,878,235 A * 10/1989 Anderson ..... 378/136
4,928,296 A * 5/1990 Kadambi ..... 378/141
4,949,369 A * 8/1990 Bittl ..... 378/130
5,018,181 A * 5/1991 Iversen et al. ..... 378/144
5,541,975 A * 7/1996 Anderson et al. ..... 378/130
5,579,364 A 11/1996 Osaka
5,737,387 A * 4/1998 Smither ..... 378/130
6,304,631 B1 * 10/2001 Snyder ..... 378/130
6,430,260 B1 * 8/2002 Snyder ..... 378/130
6,487,273 B1 * 11/2002 Takenaka et al. ..... 378/142

FOREIGN PATENT DOCUMENTS

EP 0 665 574 A1 8/1995
JP 2-197098 A 8/1990
JP 7-220667 A 8/1995

OTHER PUBLICATIONS

Patent Abstracts of Japan, vol. 014, No. 479 (E-0992), Oct. 18, 1990 and JP 02-197098 A (Nippon X-ray KK), Aug. 2, 1990 (Aug. 3, 1990)—Abstract only.
Patent Abstracts of Japan, vol. 2000, No. 09, Oct. 13, 2000 and JP 2000-164390 A (Toshiba Corp.), Jun. 16, 2000—Abstract only.

* cited by examiner

*Primary Examiner*—Allen C. Ho
(74) *Attorney, Agent, or Firm*—Frishauf, Holtz, Goodman & Chick, P.C.

(57) ABSTRACT

A coolant passage is formed inside the rotary shaft while an air passage is formed inside the casing. A mechanical seal is arranged between the coolant passage and the air passage. Leakage cooling water, which has leaked in the form of vapor from the mechanical seal, is relegated radially outwardly along with air by the action of a rotary vane, which is disposed in the air passage, and finally flows out of an air outlet. A coolant sensor may be provided to early detect the leakage water.

16 Claims, 12 Drawing Sheets

ROTATING ANODE X-RAY TUBE AND X-RAY GENERATOR

BACKGROUND OF THE INVENTION

1. Field of the Invention

The present invention relates to a rotating anode X-ray tube which is capable of coping with the coolant leakage from a rotary seal, the coolant being for cooling the inside of the rotating anode, and also relates to an X-ray generator having such a rotating anode X-ray tube.

2. Description of the Related Art

A rotating anode of a rotating anode X-ray tube is cooled at its inside by cooling water. Since the rotating anode is rotated during cooling by the cooling water, its coolant passage must be sealed by a rotary liquid-tight sealing device such as a mechanical seal or an oil seal. The sealing function of the sealing region is maintained by, in general, an elastic force. When the liquid-tight property has been deteriorated because of roughness or wear of the seal surface, water leakage occurs little by little. When the leakage water adheres to parts such as a bearing, an electric brush or a vacuum sealing device, the lifetime of the parts would be shortened disadvantageously. Accordingly, it is desirable to improve the structure so that the leakage water does not adhere to the parts even when the water leakage occurs, or to detect soon the water leakage for prompting an exchange of the rotary fluid-tight sealing device. The prior art which is material to the present invention is as described below. Japanese patent publication No. 7-220667 A (1995), the first publication, discloses a basic structure of the rotating anode X-ray tube and a coolant sealing device. Japanese patent publication No. 2-197098 A (1990), the second publication, discloses a rotating anode X-ray tube having a water leakage sensor.

In the second publication, a rotating anode X-ray tube includes a vacuum chamber which houses therein a tray arranged below the anode or target. The tray can receive leakage water dropped away the anode. When stored water in the tray reaches a predetermined height, the water touches the sensor to generate a water leakage signal. When detecting the water leakage signal, generation of the electron beam is stopped and a buzzer sounds to call user's attention to water leakage.

The above-described water leakage sensor has a following problem. The water leakage sensor focuses attention on the water leakage dropped away the anode surface into the internal space of the vacuum chamber. Such water leakage is supposed to be water leakage from a coolant passage cropping out due to target erosion caused by electron beam collision, or water leakage from a weld joint of the target.

The above-described water leakage sensor, however, can not cope with water leakage little by little caused by deterioration of a coolant sealing device. When the water leakage from the coolant sealing device occurs, water does not drop away the anode into the vacuum chamber but enters into the internal space of the casing which rotatably supports the rotating anode. When such water leakage occurs, the lifetime of parts, such as a bearing, an electric brush or a vacuum sealing device, housed in the casing is shortened disadvantageously as has been described above. The water leakage sensor disclosed in the second publication can not cope with such water leakage. Furthermore, the leakage water little by little from the coolant sealing device is not in the form of liquid but is in the form of fine-atomized droplets or vapor, which may disperses into the internal space of the casing. The type of water leakage sensor which stores water in a tray can not always detect such water leakage and can not early detect a trace of water leakage. At the stage of a trace of water leakage, it would be effective to let out water in the form of vapor to the atmosphere to prolong the lifetime of parts, but such a thing is impossible in the prior art disclosed in the second publication.

SUMMARY OF THE INVENTION

It is an object of the present invention to provide a rotating anode X-ray tube capable of effectively letting out water, which has leaked little by little from a coolant sealing device, to the atmosphere.

It is another object of the present invention to provide a rotating anode X-ray tube capable of early detecting water leaking from the coolant sealing device.

It is further another object of the present invention to provide an X-ray generator having such a rotating anode X-ray tube.

In the present invention, an air passage is formed inside a casing which supports a rotating anode, and air is introduced from the atmosphere into the air passage and is thereafter discharged to the atmosphere, with the use of a rotary vane for streaming the air automatically. That is, a rotating anode X-ray tube according to the present invention comprises: (a) a rotating anode including therein a first coolant passage; (b) an electron gun for irradiating the rotating anode with an electron beam; (c) a vacuum chamber housing therein the rotating anode and the electron gun; (d) a rotary shaft fixed to the rotating anode; (e) a casing which houses therein the rotary shaft and is secured to the vacuum chamber; (f) bearing means arranged between the rotary shaft and the casing so as to rotatably support the rotary shaft; (g) a rotary vacuum sealing device arranged between the rotary shaft and the casing; (h) a second coolant passage formed inside the rotary shaft so as to communicate with the first coolant passage; (i) a coolant inlet and a coolant outlet each provided in the casing so as to communicate with the second coolant passage; (j) an air passage formed inside the casing; (k) an air inlet and an air outlet each provided in the casing so as to communicate with the air passage; (l) a rotary liquid-tight sealing device arranged between the second coolant passage and the casing so as to provide a rotary seal between the second coolant passage and the air passage; and (m) a rotary vane which is fixed to the rotary shaft to be disposed in the air passage and has air guide means extending in a direction moving away from an axis of rotation of the rotary vane.

The rotating anode X-ray tube may have a coolant sensor communicating with the air passage for detecting water leakage. The coolant sensor may detect water in the form of liquid or in the form of vapor. One example of the former sensor is a sensor detecting an electric resistance between a pair of electrodes for sensing existence of coolant. One example of the latter sensor is a humidity sensor. The humidity sensor may consist of: an inlet humidity sensor for sensing a humidity of air entering into the air passage; and an outlet humidity sensor for sensing a humidity of air flowing out of the air passage, so as to determine moisture content caused by the water leakage.

A rotating anode X-ray tube according to the present invention may omit the rotary vane and may use the coolant sensor only. In this case, the coolant sensor may be preferably a humidity sensor.

An X-ray generator according to the present invention is characterized in that it comprises the above-described rotating anode X-ray tube and a high-voltage power supply for supplying a high voltage between the electron gun and the rotating anode. In the case where the rotating anode X-ray tube has a coolant sensor, the output signal of the coolant sensor may be transferred to the high-voltage power supply to stop the power supply in water leakage.

A rotating anode X-ray tube according to the present invention has the advantages described below. Air in the air passage formed in the casing is discharged to the atmosphere with the rotary vane, so that the cooling water leaking in the air passage in the form of vapor or atomized droplets can be soon discharged to the atmosphere. Therefore, vapor is prevented from condensing on parts such as a bearing, an electric brush or a vacuum sealing device, housed in the casing to prolong the lifetime of the parts. Further, there is provided a coolant sensor communicating with the air passage in addition to the rotary vane, so as to detect cooling water leaking from the rotary liquid-tight sealing device, to prompt an operator to exchange the rotary fluid-tight sealing device. Additionally, even when the rotary vane is omitted to use only the humidity sensor, a trace of water leakage can be detected.

DETAILED DESCRIPTION OF THE PREFERRED EMBODIMENTS

Figure 1:
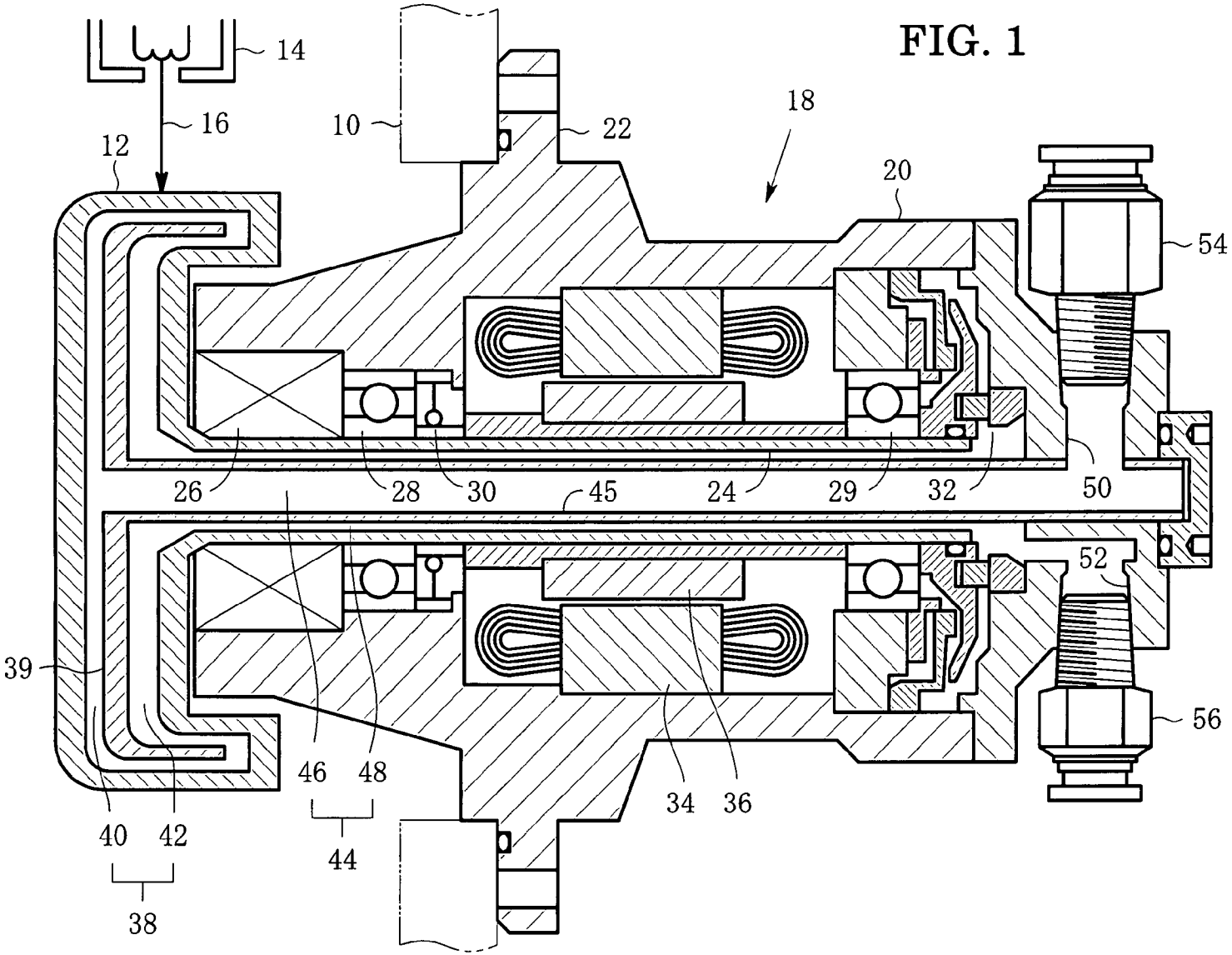
FIG. 1 is a sectional view of the principal part of one embodiment of a rotating anode X-ray tube according to the present invention.
Figure 2:
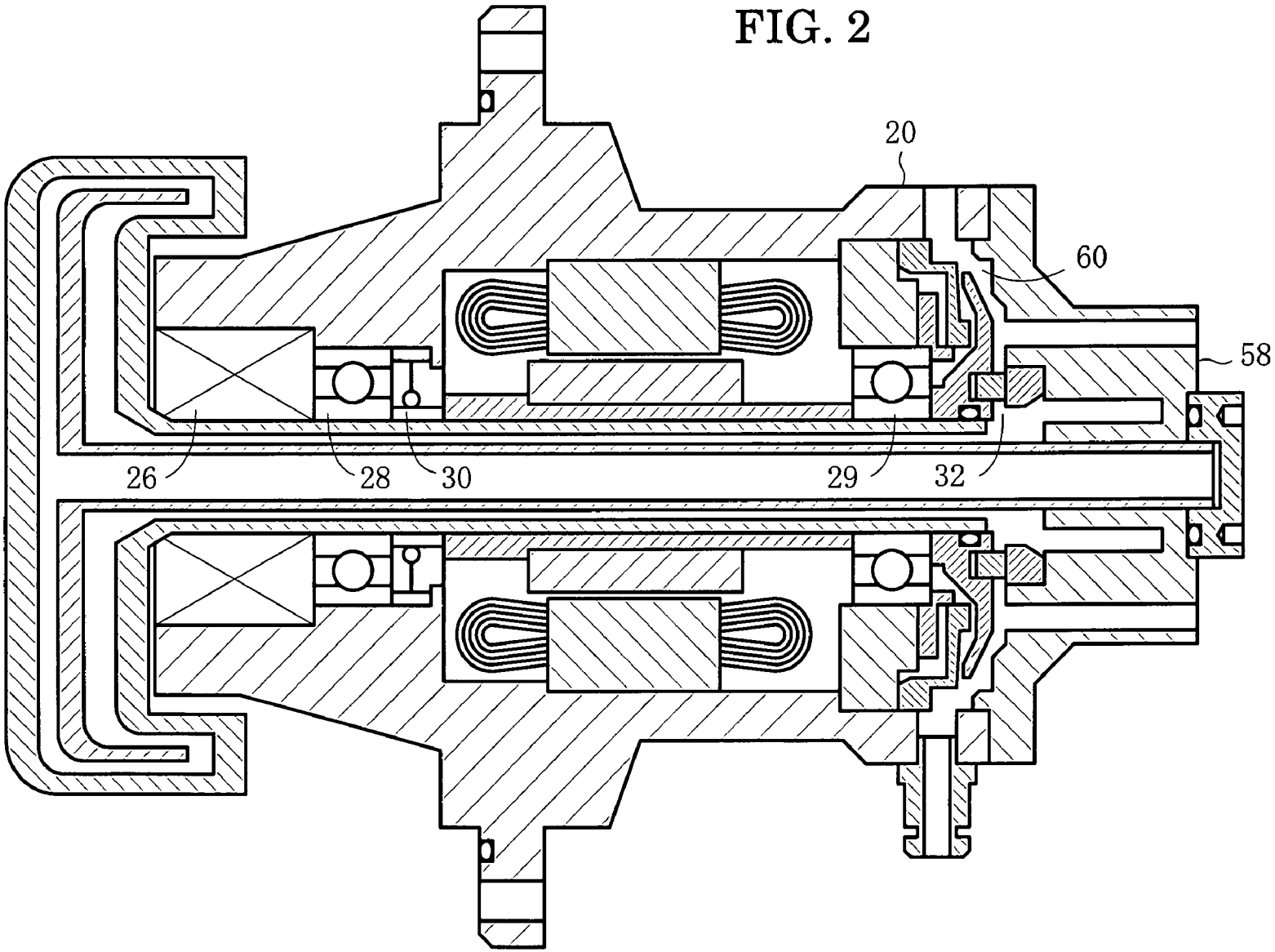
FIG. 2 is a sectional view, taken along another plane, of the rotating anode X-ray tube shown in FIG. 1.
Figure 3:
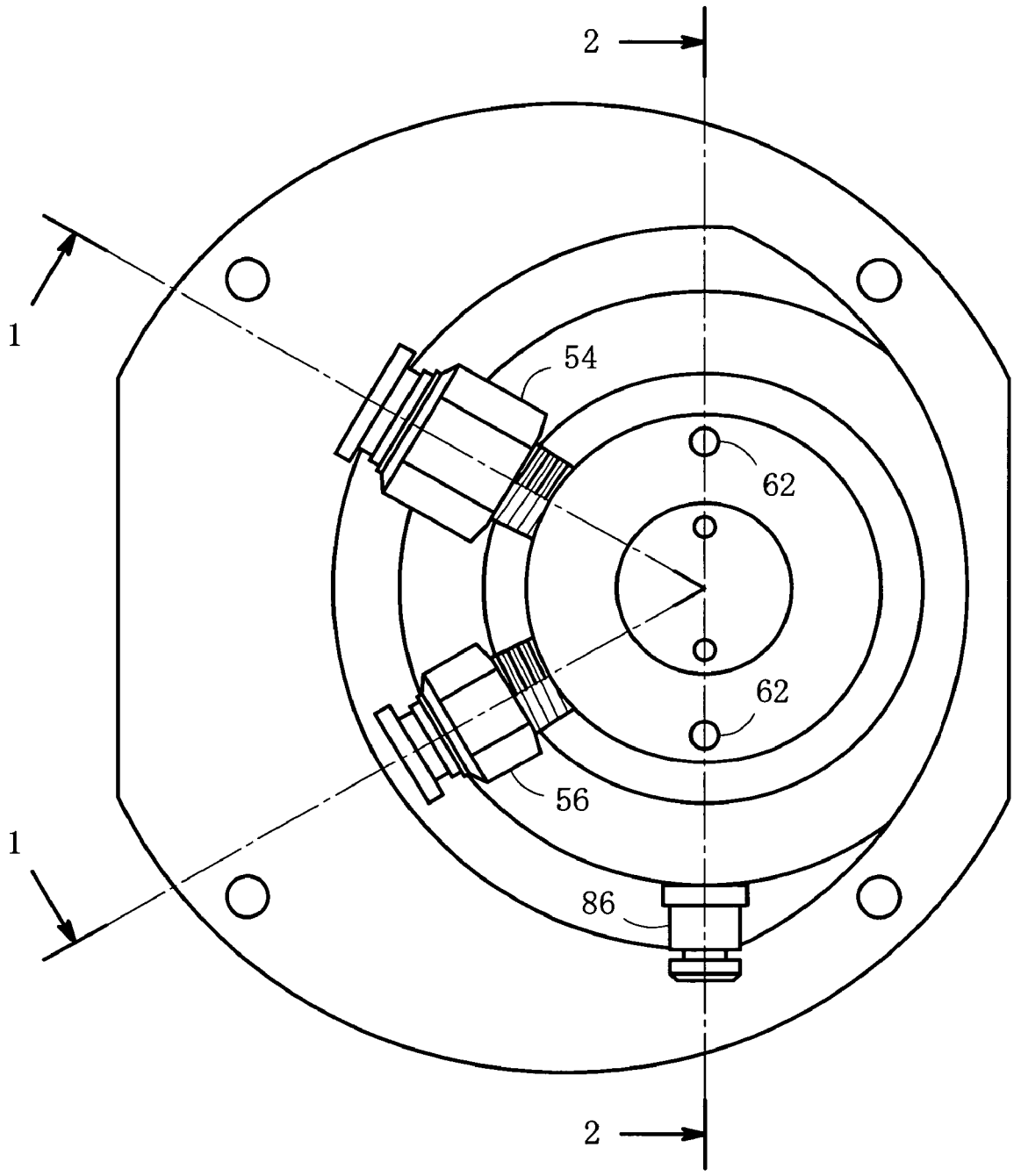
FIG. 3 is a rear view shown from the right in FIG. 1.

Embodiments of the present invention will now be described below with reference to the drawings. FIGS. 1 to 3 show the principal part of one embodiment of a rotating anode X-ray tube according the present invention. FIG. 1 is a sectional view taken along a plane including an axis of rotation of a rotating anode, especially showing clearly a coolant passage. FIG. 2 is a sectional view taken along another plane including the axis of rotation of the rotating anode, especially showing clearly an air passage. FIG. 3 is a rear view shown from the right in FIG. 1. FIG. 1 is a sectional view taken along the line 1—1 in FIG. 3, while FIG. 2 is a sectional view taken along the line 2—2 in FIG. 3.

Referring to FIG. 1, a rotating anode X-ray tube has a vacuum chamber 10, and has a rotating anode 12 and an electron gun 14 each housed in the vacuum chamber 10. A high voltage is supplied, from a high-voltage power supply, between the electron gun 14 and the rotating anode 12 to allow the electron gun 14 to generate an electron beam 16. Outer peripheral surface of the cylindrical rotating anode 12 is irradiated with the electron beam 16 to generate an X-ray. The rotating anode 12 belongs to a rotating anode assembly 18, which is secured to the vacuum chamber 10 to arrange the rotating anode 12 at the predetermined position in the internal space of the vacuum chamber 10.

The rotating anode assembly 18 has a casing 20 whose flange 22 can be airtightly secured to the vacuum chamber 10. The rotating anode 12 is fixed to a rotary shaft 24. Between the outer peripheral surface of the rotary shaft 24 and the inner surface of the casing 20 are arranged a magnetic fluid sealing device 26 providing a rotary vacuum seal, ball bearings 28 and 29 for rotatably supporting the rotary shaft 24, an electric brush 30 for discharging a current from the rotary shaft 24 to the casing 20, and a mechanical seal 32 providing a rotary seal for sealing cooling water. The magnetic fluid sealing device 26 corresponds to the rotary vacuum sealing device in the present invention. The mechanical seal 32 corresponds to the rotary liquid-tight sealing device in the present invention. To the inner surface of the casing 20 is fixed a stator 34 of a direct drive motor, while to the outer surface of the rotary shaft 24 is fixed a rotor 36 of the direct drive motor. The direct drive motor rotates the rotary shaft 24 further to rotate the rotating anode 12.

Inside the rotating anode 12 is formed the first coolant passage 38 which is divided, by a partition plate 39, into the first inflow passage 40 and the first outflow passage 42. Inside the rotary shaft 24 is formed the second coolant passage 44 which is also divided, by a partition pipe 45, into the second inflow passage 46 arranged inside and the second outflow passage 48 arranged outside. The partition plate 39 is fixed to the partition pipe 45 whose root, i.e., the right edge in FIG. 1, is fixed to the casing 20. The rotating anode 12 and the rotary shaft 24 can be rotated, while the partition plate 39 and the partition pipe 45 disposed therein remain stationary. The first inflow passage 40 communicates with the second inflow passage 46, while the first outflow passage 42 communicates with the second outflow passage 48. The casing 20 is provided with a coolant inlet 50 and a coolant outlet 52. An inlet piping nipple 54 is secured to the coolant inlet 50 while an outlet piping nipple 56 is secured to the coolant outlet 52, see also FIG. 3. The cooling water having entered into the coolant inlet 50 is to pass through the second inflow passage 46 and enter into the first inflow passage 40 to cool the internal surface of the rotating anode 12. The returning cooling water passes through the first outflow passage 42 and the second outflow passage 48 and flows out of the coolant outlet 52.

Figure 4:
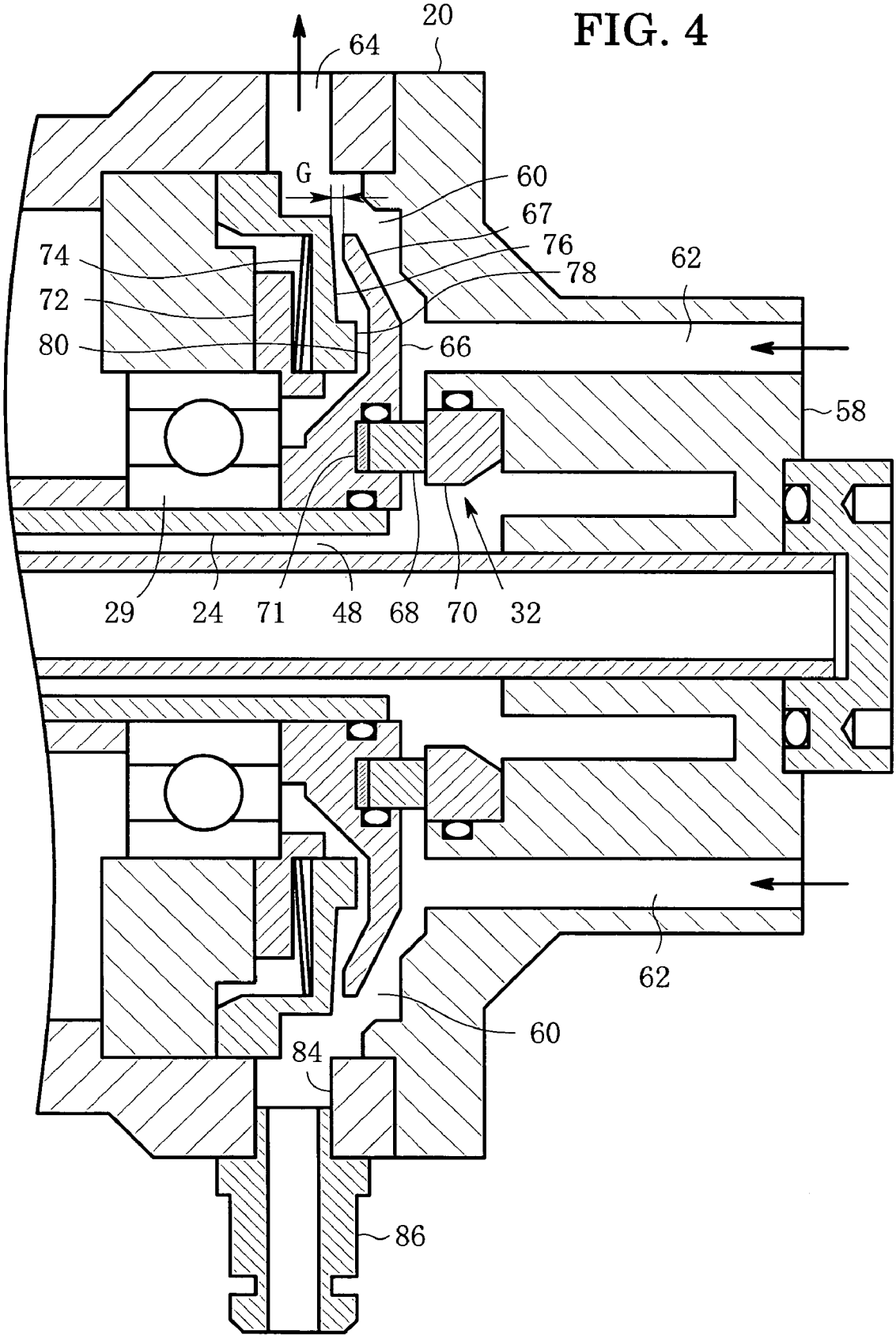
FIG. 4 is an enlarged sectional view showing the vicinity of an air passage.

Referring next to FIGS. 2 and 4, an air flow will be described. Referring to FIG. 2, an air passage 60 is formed inside the casing 20 in the vicinity of the backside 58 of the casing 20. Referring to FIG. 4 which is an enlarged sectional view showing the vicinity of the air passage 60, two air inlets 62 (see also FIG. 3) are formed in the backside 58 of the casing 20. Furthermore, one air outlet 64 is formed in the outer peripheral surface of the casing 20. The air inlets 62 and the air outlet 64 both communicate with the air passage 60 inside which a rotary vane 66 is disposed. The rotary vane 66 is secured to the rotary shaft 24. The air outlet 64 is positioned radially outside of the outer periphery of the rotary vane 66, while the air inlets 62 are positioned radially inside of the outer periphery of the rotary vane 66. The mechanical seal 32 is arranged between the rotary vane 66 and the casing 20. The mechanical seal 32 consists of a rotary ring 68 made of carbon arranged at the rotating-side, and a seat ring 70 made of SiC arranged at the stationary-side. The rotary ring 68 is housed in an annular groove formed in the rotary vane 66. A rubber sheet 71 is arranged inside the groove so as to push the rotary ring 68 against the seat ring 70 under the elastic force of the rubber sheet 71. The rotary ring 68 can be rotated during contact with the seat ring 70 to provide a seal between the cooling water inside the second outflow passage 48 and the air inside the air passage 60.

An outer race of the ball bearing 29 is correctly positioned axially by a bearing retainer 72, which receives an axial force, i.e., a leftward force in FIG. 4, via a coned disc spring 74 from a coned disc spring retainer 76. The rotary vane 66 is provided with a recess 80 which covers a projection 78 of the coned disc spring retainer 76. The gap G between the coned disc spring retainer 76 and the rotary vane 66 is 0.3 to 0.5 mm.

When the rotary vane 66 is rotated inside the air passage 60, a disc-shaped air guide 67 of the rotary vane 66 lets out the air in the air passage 60 radially outwardly, so that the air flows out of the air outlet 64. Then, since the pressure in the air passage 60 decreases, air enters into the air passage 60 from the air inlet 62. In this manner during rotation of the rotating anode, the atmospheric air outside the casing 20 can circulate in the air passage 60.

Figure 5:
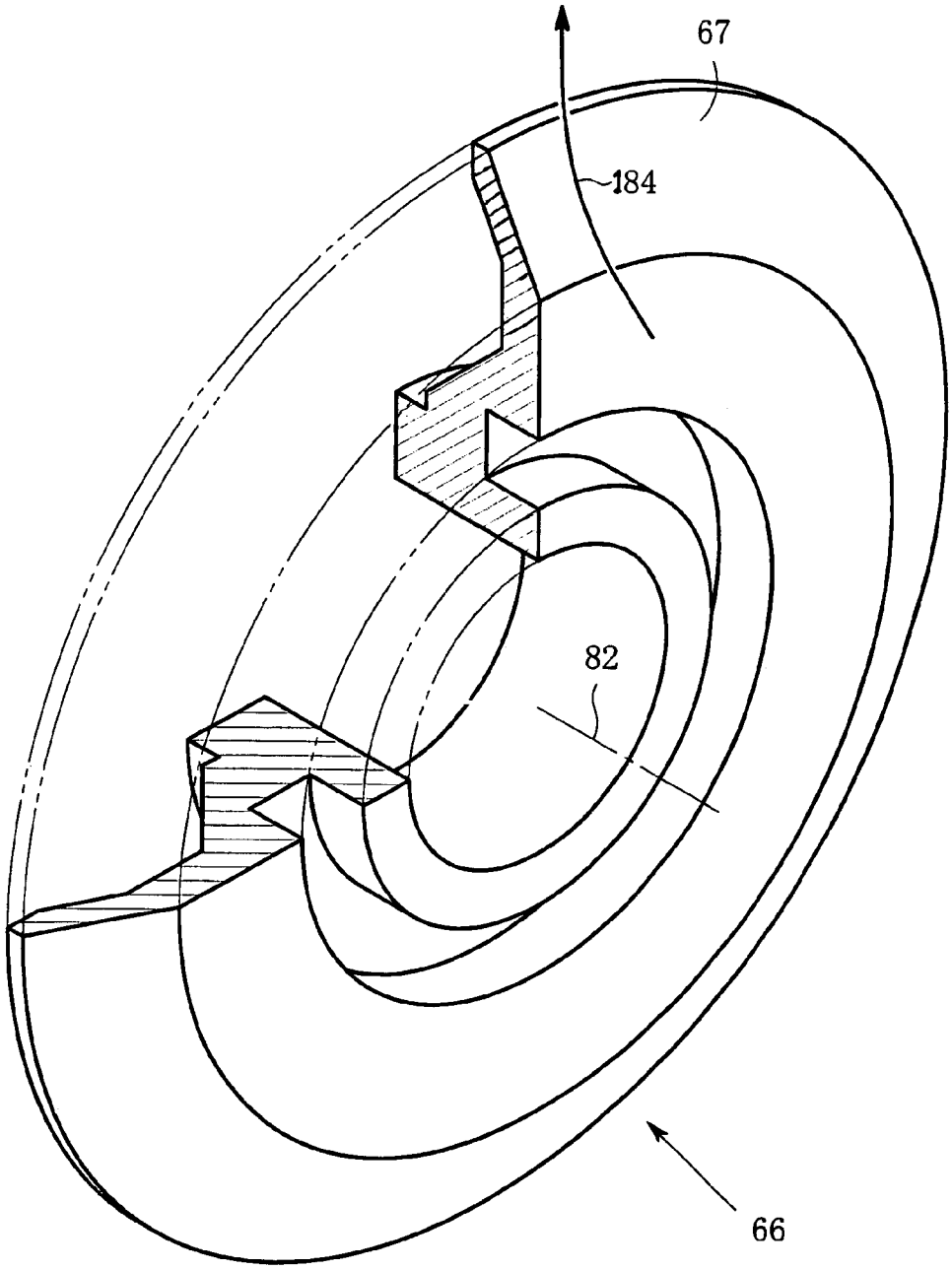
FIG. 5 is a perspective view of a rotary vane partly cut out.

Referring to FIG. 5 which is a perspective view of a rotary vane 66 partly cut out, the rotary vane 66 has the disc-shaped air guide 67, which extends, in the sectional shape, in a direction moving away from an axis of rotation 82. When the rotary vane 66 is rotated, the air around the air guide 67 is to be rotated along with the air guide due to its viscosity, and further to be let out, due to the centrifugal force, radially outwardly along the air guide 67 as indicated by an arrow 184. The air guide 67 may have any shape other than a disc shape, such as a blade for use in a fan.

Referring back to FIG. 4, the function of the rotary vane 66 will be described. When the seal surface of the mechanical seal 32 has been deteriorated, the cooling water may leak little by little from the seal surface into the air passage 60. In the case of a trace of water leakage, the water leaks in the form of fine-atomized droplets or vapor. In the conventional rotating anode, the droplets or vapor adheres to the ball bearing 29 and is condensed thereon. Furthermore, there is the danger that the vapor flows, as shown in FIG. 2, toward the electric brush 30, the bearing 28, and the magnetic fluid sealing device 26 and is condensed thereon. In this manner, there is a risk in which the leakage water from the mechanical seal 32 would shorten the lifetime of the various parts in the casing 20. In contrast, in the present invention, as shown in FIG. 4, since the air in the air passage 60 flows out of the air outlet 64 due to the rotation of the rotary vane 66, even when the water leaks from the mechanical seal 32 in the form of atomized droplets or vapor, the droplets or vapor is soon discharged, along with the air, out of the air outlet 64. Therefore, there is almost no danger of vapor flowing toward the parts inside the casing 20 and being condensed thereon. Additionally, since the gap G between the rotary vane 66 and the coned disc spring retainer 76 is narrow, it would be hard for vapor to pass through the gap G against the centrifugal force.

In this embodiment, the casing 20 is provided with a detection port 84 for detecting leakage water into the air passage 60. The detection port 84 communicates with the air passage 60 and is positioned radially outside of the outer periphery of the rotary vane 66. A cooling sensor is connected to the detection port 84. In the embodiment shown in FIG. 4, to the detection port 84 is connected a piping nipple 86, to which the coolant sensor is connected.

Figure 6:
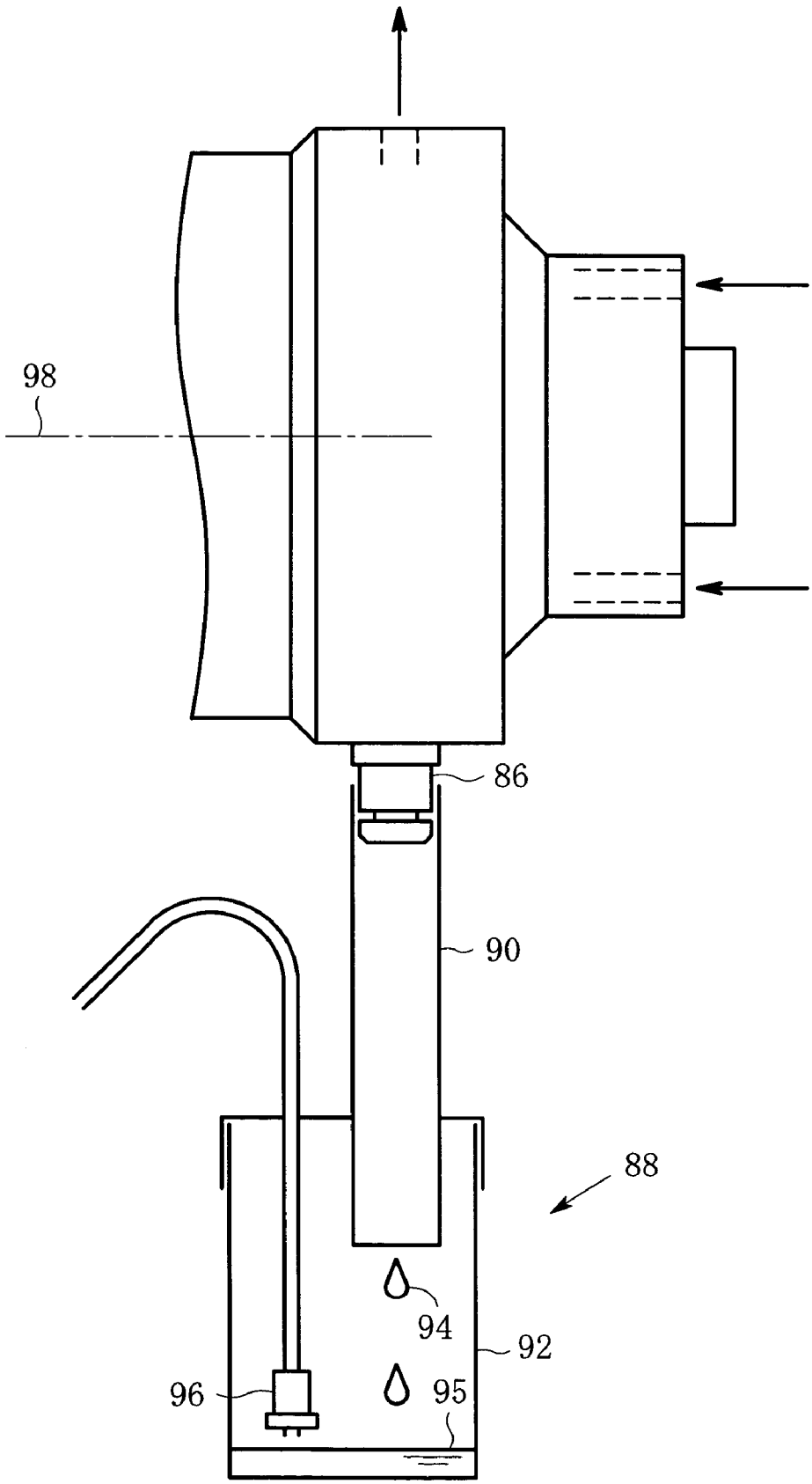
FIG. 6 is a side view of a rotating anode X-ray tube having a coolant detector.

Referring to FIG. 6 which is a side view of a rotating anode X-ray tube having a coolant detector 88, a hose 90 is connected to the piping nipple 86. The end of the hose 90 opens in the internal space of a liquid vessel 92. Cooling water 94 drops away from the hose 90 to be stored in the liquid vessel 92. When the stored water 95 reaches the predetermined water level, a liquid leakage sensor 96 operates to generate an output signal representative of the water leakage. The liquid leakage sensor 96 can detect an electric resistance between a pair of electrodes for detecting existence of water. In the case of output of the water leakage signal, the output signal is transferred to the high-voltage power supply, resulting in automatic shutdown of the power supply, followed by halt of the rotation of the rotating anode and halt of supply of the cooling water. Furthermore, an alarm buzzer may sound or an alarm lamp may turn on to inform an operator of water leakage, so that the operator can exchange the mechanical seal.

Figure 7:
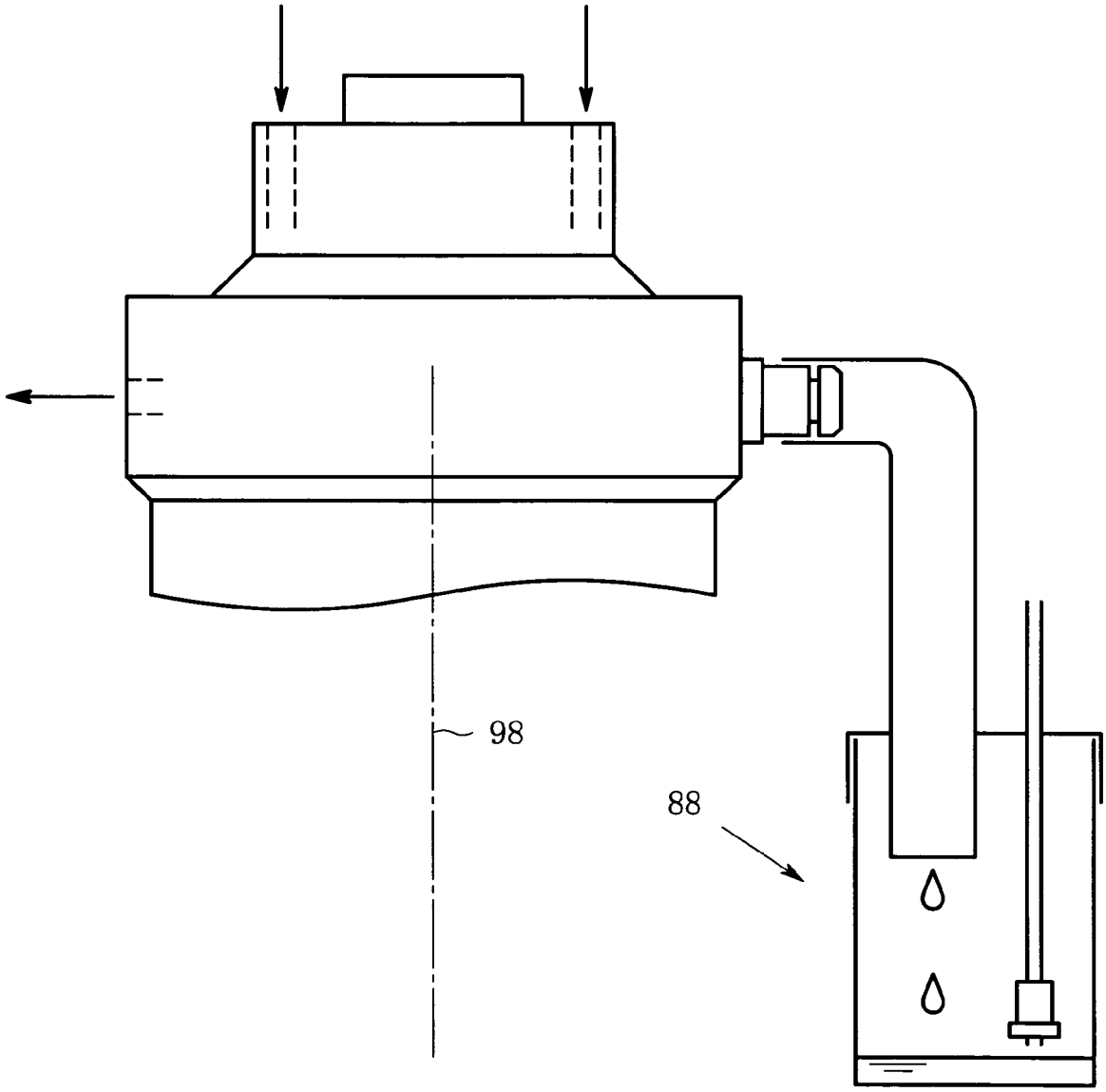
FIG. 7 is a side view of an embodiment having an upright axis of rotation of the rotating anode.
Figure 8:
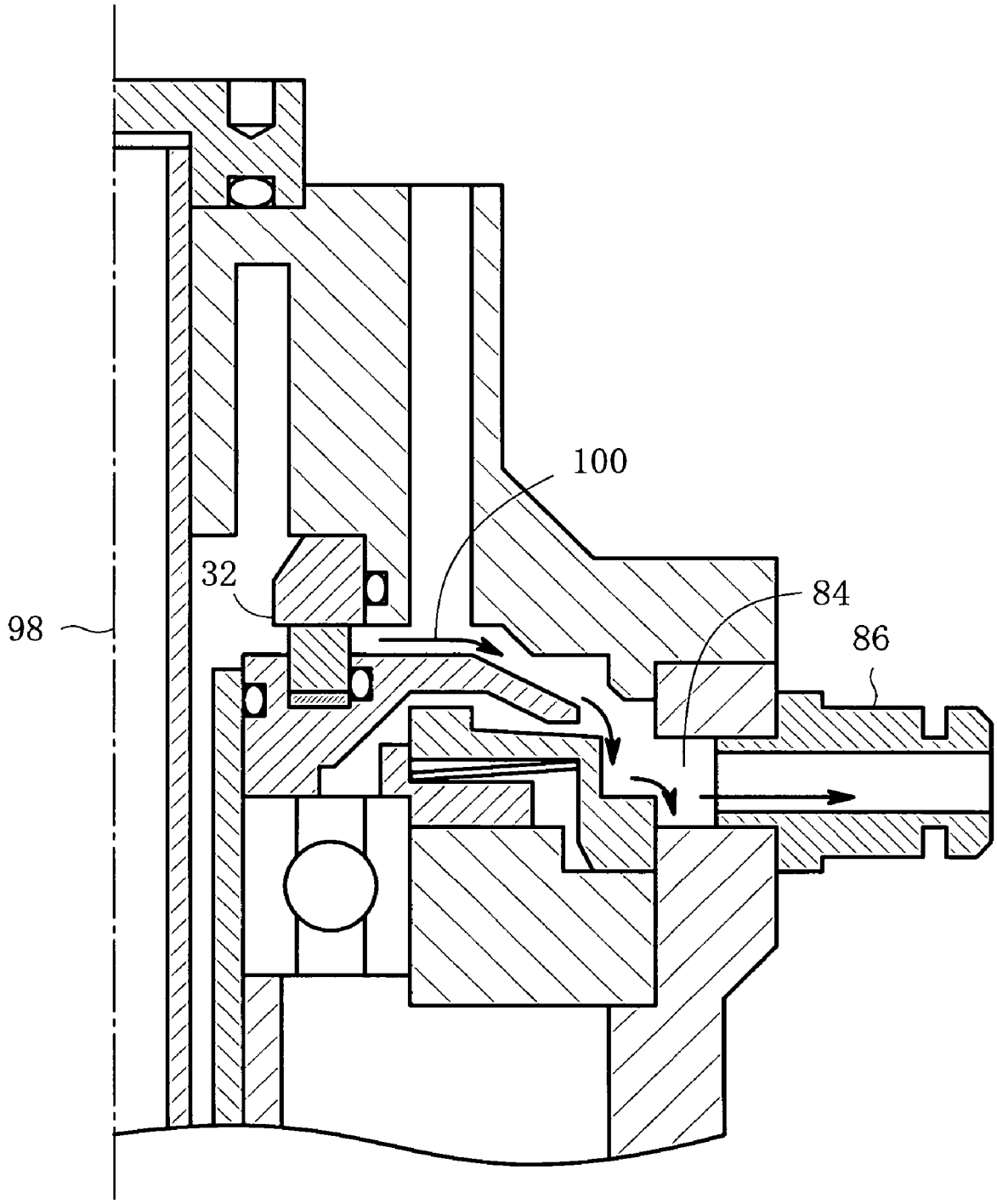
FIG. 8 is a sectional view indicating a flow of water leakage in the arrangement shown in FIG. 7.

FIG. 7 shows an embodiment in which an attitude of a rotating anode is changed from a horizontal position to the vertical position. That is, the embodiment shown in FIG. 6 has a horizontal axis of rotation 98 of the rotating anode X-ray tube, while the embodiment shown in FIG. 7 has a vertical axis of rotation 98 of the rotating anode X-ray tube. In this case, the leakage water flow is shown in FIG. 8, which is a sectional view indicating a flow of water leakage in the arrangement shown in FIG. 7. Cooling water 100 leaking from the mechanical seal 32 flows as indicated by an arrow 100 and finally flows out of the piping nipple 86. In the case of the vertical arrangement, since the detection port 84 is positioned at a level lower than the level of the mechanical seal 32, cooling water 100 leaking from the mechanical seal 320 can flow to the detection port 84, and is finally discharged out of the nipple 86.

Figure 9:
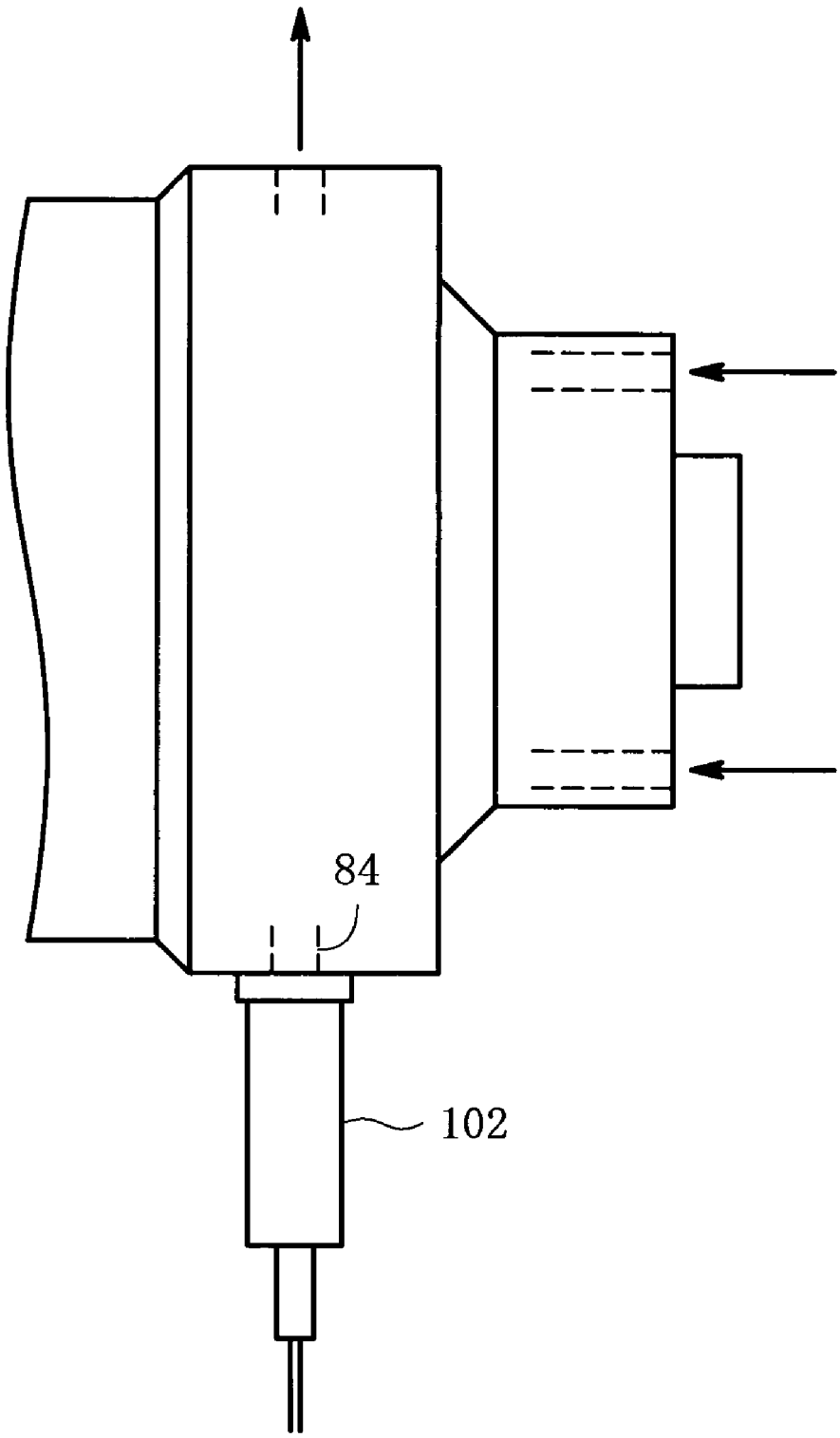
FIG. 9 is a side view of an embodiment using a humidity sensor as the coolant sensor.

Next, an embodiment using a humidity sensor as the coolant sensor will be described, with referring to FIG. 9 which is a side view of such an embodiment. To the detection port 84 (see also FIG. 4) is connected a humidity sensor 102, which can early detect cooling water leaking in the form of fine-atomized droplets or vapor. In is noted that the sensor used in the embodiment is a combination sensor consisting of a temperature sensor and a humidity sensor.

Figure 10:
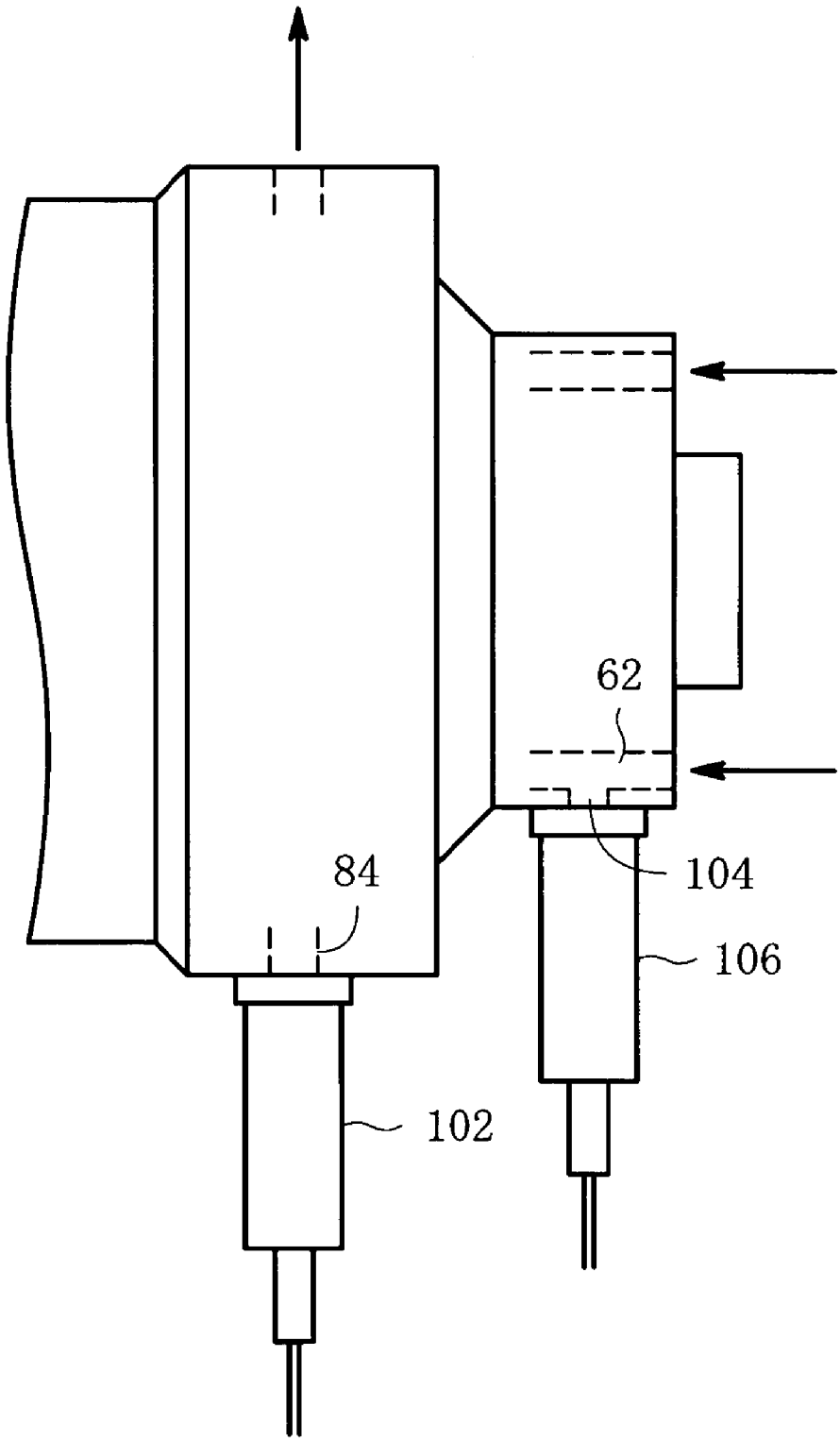
FIG. 10 is a side view of another embodiment using humidity sensors as the coolant sensor.

Referring to FIG. 10 showing further another embodiment, one of the air inlets 62 is provided with another detection port 104 for inflow air. In the detection port 104 is arranged a humidity sensor 106 for the inflow air, the sensor 106 being referred to as an inlet humidity sensor 106. On the other hand, a humidity sensor 102 arranged in the outlet-side detection port 84 is referred to as an outlet humidity sensor 102. With this arrangement, the humidity of inflow air and the humidity of outflow air can be compared with one another to determine increased moisture content in the air passage inside the casing, i.e., the moisture content having leaked from the mechanical seal.

Figure 11:
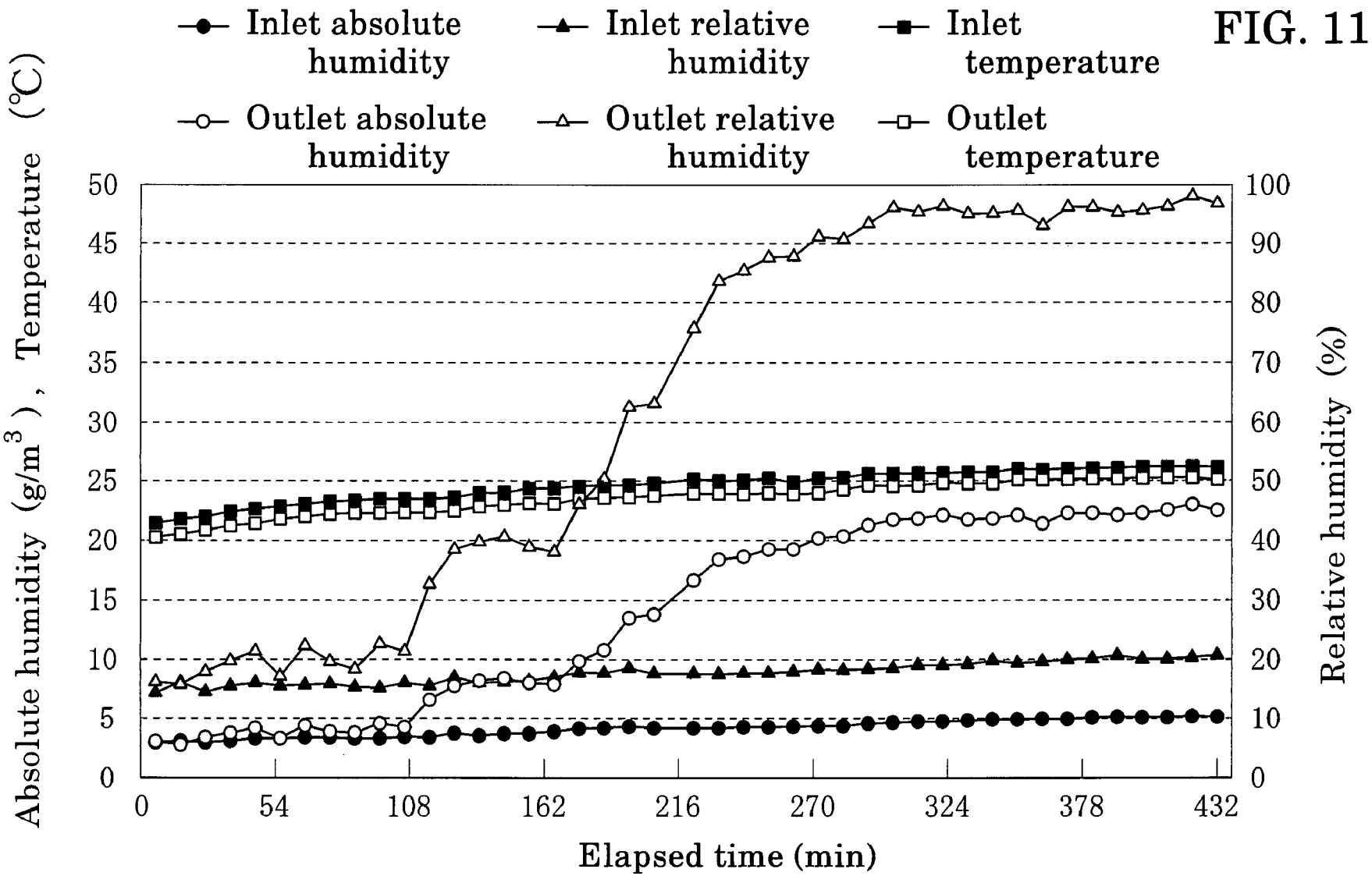
FIG. 11 is a graph showing measured humidity variations.

FIG. 11 is a graph showing humidity variations measured using the inlet humidity sensor and the outlet humidity sensor. Abscissa represents an elapsed time, in minute, during rotation of the rotating anode x-ray tube, the origin of the time scale being a time point at which measurement is commenced with the humidity sensors. A scale on the left ordinate is common to absolute humidity, in gram per cubic meter, and a temperature, in degrees Celsius. A scale on the right ordinate is relative humidity, in percent. The temperature/humidity sensor can detect the relative humidity and the temperature. The absolute humidity can be calculated based on the relative humidity and the temperature. The graph of FIG. 11 indicates measured relative humidity, measured temperatures and calculated absolute humidity.

Referring to FIG. 11, comparing the inlet relative humidity with the outlet relative humidity, it is seen that the outlet relative humidity begins to increase at 108 minutes in elapsed time and the increase continues gradually until about 300 minutes. The absolute humidity represents a similar trend. These trends indicate the state in which the seal surface of the mechanical seal begins to be deteriorated. Thus, with the use of the humidity sensors, cooling water leakage can be soon detected at an early stage. In the case of detection of water leakage, an alarm may be raised to prompt an operator to exchange the mechanical seal.

Figure 12:
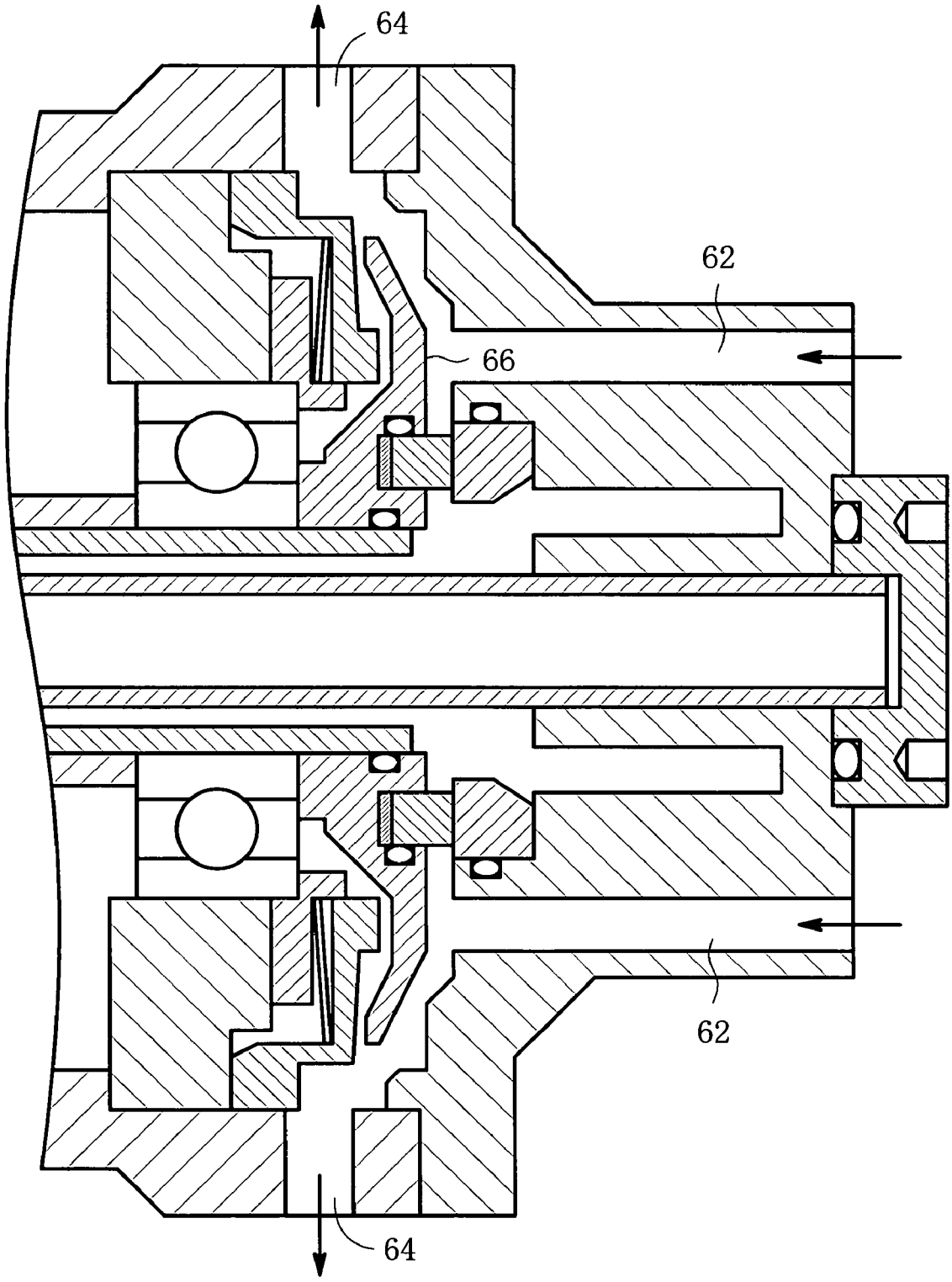
FIG. 12 is a sectional view of further another embodiment of the present invention.

FIG. 12 shows further another embodiment of the present invention. This embodiment has the rotary vane 66 but no coolant sensor, and accordingly has only the function of discharging cooling water which has leaked from the mechanical seal 32 in the form of atomized droplets or vapor, to the outside along with air. This embodiment has two air inlets 62 and two air outlets 64, so that dew condensation on the parts inside the casing is prevented from occurring to prolong the lifetime of the parts. The mechanical seal may preferably be exchanged for a new one at regular intervals to lower the risk of water leakage in the form of liquid.

Further, the present invention may omit the rotary vane in the case of using the humidity sensor as the coolant sensor. That is, in the embodiment shown in FIG. 9 (having one humidity sensor) or shown in FIG. 10 (having two humidity sensors), the rotary vane inside the casing may be omitted. In this case, since there is no function of air circulation caused by the rotary vane, a small air pump may be provided on the outer surface of the casing, so that dry air from the pump may enter into the air inlet of the casing. The air flow rate of the pump may be very small.

It is noted that although cooling water is used as the coolant in the embodiments described above, any other coolant may be used.

What is claimed is:

1. A rotating anode X-ray tube comprising:

(a) a rotating anode including therein a first coolant passage;

(b) an electron gun for irradiating the rotating anode with an electron beam;

(c) a vacuum chamber housing therein the rotating anode and the electron gun;

(d) a rotary shaft fixed to the rotating anode;

(e) a casing which houses therein the rotary shaft and is secured to the vacuum chamber;

(f) bearing means arranged between the rotary shaft and the casing so as to rotatably support the rotary shaft;

(g) a rotary vacuum sealing device arranged between the rotary shaft and the casing;

(h) a second coolant passage formed inside the rotary shaft so as to communicate with the first coolant passage;

(i) a coolant inlet and a coolant outlet each provided in the casing so as to communicate with the second coolant passage;

(j) an air passage formed inside the casing;

(k) an air inlet and an air outlet each provided in the casing so as to communicate with the air passage;

(l) a rotary liquid-tight sealing device arranged between the second coolant passage and the casing so as to provide a rotary seal between the second coolant passage and the air passage; and (m) a rotary vane which is fixed to the rotary shaft to be disposed in the air passage and has air guide means extending in a direction moving away from an axis of rotation of the rotary vane.

2. A rotating anode X-ray tube according to claim 1, further comprising a coolant sensor communicating with the air passage.

3. A rotating anode X-ray tube according to claim 2, wherein the coolant sensor is a sensor detecting an electric resistance between a pair of electrodes for sensing existence of coolant.

4. A rotating anode X-ray tube according to claim 2, wherein coolant is cooling water and the coolant sensor is a humidity sensor.

5. A rotating anode X-ray tube according to claim 4, wherein the humidity sensor consists of:

an inlet humidity sensor for sensing a humidity of air entering into the air passage; and an outlet humidity sensor for sensing a humidity of air flowing out of the air passage.

6. A rotating anode X-ray tube according to claim 1, wherein a rotating-side seal member of the rotary liquid-tight sealing device is secured to the rotary vane.

7. A rotating anode X-ray tube comprising:

(a) a rotating anode including therein a first coolant passage;

(b) an electron gun for irradiating the rotating anode with an electron beam;

(c) a vacuum chamber housing therein the rotating anode and the electron gun;

(d) a rotary shaft fixed to the rotating anode;

(e) a casing which houses therein the rotary shaft and is secured to the vacuum chamber;

(f) bearing means arranged between the rotary shaft and the casing so as to rotatably support the rotary shaft;

(g) a rotary vacuum sealing device arranged between the rotary shaft and the casing;

(h) a second coolant passage formed inside the rotary shaft so as to communicate with the first coolant passage;

(i) a coolant inlet and a coolant outlet each provided in the casing so as to communicate with the second coolant passage;

(j) an air passage formed inside the casing;

(k) an air inlet and an air outlet each provided in the casing so as to communicate with the air passage;

(l) a rotary liquid-tight sealing device arranged between the second coolant passage and the casing so as to provide a rotary seal between the second coolant passage and the air passage; and (m) a humidity sensor communicating with the air passage.

8. A rotating anode X-ray tube according to claim 7, wherein the humidity sensor consists of:

an inlet humidity sensor for sensing a humidity of air entering into the air passage; and an outlet humidity sensor for sensing a humidity of air flowing out of the air passage.

9. An X-ray generator comprising:

(A) a rotating anode X-ray tube including:

(a) a rotating anode including therein a first coolant passage;

(b) an electron gun for irradiating the rotating anode with an electron beam;

(c) a vacuum chamber housing therein the rotating anode and the electron gun;
(d) a rotary shaft fixed to the rotating anode;
(e) a casing which houses therein the rotary shaft and is secured to the vacuum chamber;
(f) bearing means arranged between the rotary shaft and the casing so as to rotatably support the rotary shaft;
(g) a rotary vacuum sealing device arranged between the rotary shaft and the casing;
(h) a second coolant passage formed inside the rotary shaft so as to communicate with the first coolant passage;
(i) a coolant inlet and a coolant outlet each provided in the casing so as to communicate with the second coolant passage;
(j) an air passage formed inside the casing;
(k) an air inlet and an air outlet each provided in the casing so as to communicate with the air passage;
(l) a rotary liquid-tight sealing device arranged between the second coolant passage and the casing so as to provide a rotary seal between the second coolant passage and the air passage; and
(m) a rotary vane which is fixed to the rotary shaft to be disposed in the air passage and has air guide means extending in a direction moving away from an axis of rotation of the rotary vane; and (B) a high-voltage power supply for supplying a high voltage between the electron gun and the rotating anode.

10. An X-ray generator according to claim 9, wherein the rotating anode X-ray tube further includes a coolant sensor communicating with the air passage.

11. An X-ray generator according to claim 10, wherein the coolant sensor is a sensor detecting an electric resistance between a pair of electrodes for sensing existence of coolant.

12. An X-ray generator according to claim 10, wherein coolant is cooling water and the coolant sensor is a humidity sensor.

13. An X-ray generator according to claim 12, wherein the humidity sensor consists of:

an inlet humidity sensor for sensing a humidity of air entering into the air passage; and an outlet humidity sensor for sensing a humidity of air flowing out of the air passage.

14. An X-ray generator according to claim 9, wherein a rotating-side seal member of the rotary liquid-tight sealing device is secured to the rotary vane.

15. An X-ray generator comprising:

(A) a rotating anode X-ray tube including:
(a) a rotating anode including therein a first coolant passage;
(b) an electron gun for irradiating the rotating anode with an electron beam;
(c) a vacuum chamber housing therein the rotating anode and the electron gun;
(d) a rotary shaft fixed to the rotating anode;
(e) a casing which houses therein the rotary shaft and is secured to the vacuum chamber;
(f) bearing means arranged between the rotary shaft and the casing so as to rotatably support the rotary shaft;
(g) a rotary vacuum sealing device arranged between the rotary shaft and the casing;
(h) a second coolant passage formed inside the rotary shaft so as to communicate with the first coolant passage;
(i) a coolant inlet and a coolant outlet each provided in the casing so as to communicate with the second coolant passage;
(j) an air passage formed inside the casing;
(k) an air inlet and an air outlet each provided in the casing so as to communicate with the air passage;
(l) a rotary liquid-tight sealing device arranged between the second coolant passage and the casing so as to provide a rotary seal between the second coolant passage and the air passage; and
(m) a humidity sensor communicating with the air passage.

(B) a high-voltage power supply for supplying a high voltage between the electron gun and the rotating anode.

16. An X-ray generator according to claim 15, wherein the humidity sensor consists of:

an inlet humidity sensor for sensing a humidity of air entering into the air passage; and an outlet humidity sensor for sensing a humidity of air flowing out of the air passage.

* * * * *